US006210057B1

(12) United States Patent
Yannaci et al.

(10) Patent No.: US 6,210,057 B1
(45) Date of Patent: Apr. 3, 2001

(54) MULTIPURPOSE APPLICATOR

(76) Inventors: Thomas R. Yannaci; Hye Yong Yannacci, both of 216 Duncan Rd., Spring Lake, NC (US) 28390

( * ) Notice: Subject to any disclaimer, the term of this patent is extended or adjusted under 35 U.S.C. 154(b) by 0 days.

(21) Appl. No.: 09/548,798

(22) Filed: Apr. 14, 2000

(51) Int. Cl.[7] ..... A46B 5/02

(52) U.S. Cl. ..... 401/6; 401/205; 401/150; 401/270; 401/272

(58) Field of Search ..... 401/6, 150, 149, 401/171, 173, 174, 176, 177, 205, 270, 272

(56) References Cited

U.S. PATENT DOCUMENTS

| | | | | |
|---|---|---|---|---|
| 3,519,364 | * | 7/1970 | Truhan | 401/177 |
| 4,483,636 | * | 11/1984 | Meyer | 401/171 |
| 5,042,955 | * | 8/1991 | Moscatelli | 401/174 |
| 5,123,763 | * | 6/1992 | Simmons | 401/176 |
| 5,301,381 | | 4/1994 | Klupt . | |
| 5,388,700 | * | 2/1995 | Per-Lee | 401/6 |
| 5,649,334 | | 7/1997 | Henriquez et al. . | |
| 5,857,233 | | 1/1999 | Wynn . | |
| 5,931,590 | * | 8/1999 | Harris | 401/6 |
| 5,960,503 | | 10/1999 | Del Pozo Y Mattei . | |
| 5,984,555 | * | 11/1999 | Samad | 401/176 |
| 6,042,286 | * | 3/2000 | Pazienza | 401/6 |

* cited by examiner

*Primary Examiner*—David J. Walczak
(74) *Attorney, Agent, or Firm*—Michael I. Kroll

(57) ABSTRACT

A multipurpose liquid applicator that combines bathing functions one comprehensive unit, having no powered components. The applicator has a long handle for cleaning hard to reach areas such as the back, and an upper hollow handle section that acts a reservoir for liquid soap, suntan lotion, moisturizing lotion, etc. Liquids may be either poured directly into the reservoir or, using the lower handle which fits within the upper section and acts as a suctioning and pumping device, the liquids may be extracted from their containers into the reservoir for temporary storage and thereafter, pumped into the applicator head and to the applicator for use in cleansing. Three interchangeable applicator heads fit into the applicator head subassembly: one, a sponge head for bathing; two, a hollow flexible rubber head for massaging the body and three, a soft bristle brush head for scrubbing, all of which allow for the continual application of lotion, soap or other liquids during bathing or massaging. The applicator head subassembly has a screw type connection that interfaces with a cooperating threaded upper portion of the handle. It also has a fluid cavity within for the containment of liquids therein and a matrix of outlet apertures through which the liquid passes into applicator head. The interchangeable heads are set at an ergonomically determined angle to the handle to achieve maximum surface contact. The heads are also made of a pliable material that more easily conforms to body contours for maximum comfort and effective cleansing.

11 Claims, 12 Drawing Sheets

MULTIPURPOSE APPLICATOR

BACKGROUND OF THE INVENTION

1. Field of the Invention

The present invention relates generally to bathing accessories and, more specifically, to a multipurpose application, cleansing and massaging device. Prior art in the field of bathing accessories have generally provided electrically and hydraulically powered devices having rotating or oscillating heads and needing batteries or water running through the device. Singular function devices are also known, e.g., lotion applicators, back brushes, lotion dispensers, etc. The present invention, the multipurpose applicator, combines all of the functions generally associated with bathing into one simple, though comprehensive device, with a choice of several stationary heads, which requires no electrical power nor circulating water. It has a long handle for cleaning the back. The handle also serves as an extractor and pump for the loading and dispensing of various types of liquids associated with the bathing process. It also includes three interchangeable applicator heads, a sponge head for bathing, a brush for back scrubbing and a hollow flexible rubber head for massaging the body, all heads allowing for the continual dispensing of lotions or other liquids during bathing or massaging.

2. Description of the Prior Art

There are other bathing accessory devices designed for assistance with bathing activities. Typical of these is U.S. Pat. No. 5,857,233 issued to Emery G. Wynn on Jan. 12, 1999.

Another patent was issued to Jorge de Jesus Matias Henriquez et al. on Jul. 22, 1997 as U.S. Pat. No. 5,649,334. Yet another U.S. Pat. No. 5,960,503 was issued to Gilberto R. Del Pozo Y Mattei on Oct. 5, 1999 and still yet another was issued on Apr. 12, 1994 to Michael F. Klupt as U.S. Pat. No. 5,301,381.

A body lotion applicator including a housing with a handle portion and a head portion. Further provided is a rotating lotion applicator assembly situated with the head portion of the housing including a lotion applicator pad. Also situated with the head portion of the housing is a driving motor adapted for effecting the rotation of the lotion applicator pad upon the actuation thereof. A battery is situated with the handle portion of the housing in electrical communication with the motor via a pair of wires for actuating the motor. Also provided is a mercury switch employed to allow actuation of the motor only when the applicator is situated upright.

A primary fluid, e.g. water, and auxiliary fluid, e.g. soap, dispensing scrubber apparatus includes a pistol-shaped housing, which has a hand-grip portion and a scrubber-holder portion. A primary fluid conveyance assembly includes, in sequence, an inlet end, a pre-valve conduit, a valve assembly, a post-valve conduit, and an outlet end. A flexible hose has one end connected to the inlet end of the primary fluid conveyance assembly and has another end which includes a faucet connector. Rechargeable batteries are housed within the housing and power a DC motor. A trigger-containing switch assembly is connected between the motor and the batteries. A drive shaft is connected to the motor, and a scrubber is connected to the drive shaft. A spray nozzle is connected to the outlet end of the post-valve conduit. The drive shaft is hollow and forms a portion of the post-valve conduit of the primary fluid conveyance assembly. A fluid-tight seal is connected between a lead-in portion of the post-valve conduit and the hollow drive shaft. A motor armature includes a hollow armature shaft which serves as a drive shaft and also forms a portion of the post-valve conduit of the primary fluid conveyance assembly. The scrubber head may be in the form of a brush or a sponge. A container assembly, connected to the housing, contains a quantity of an auxiliary fluid which is moved to the valve assembly through a feed tube.

The present invention refers to an electric, hydraulic, kitchen utensil cleaning tool, being adapted for use with on hand to wash all types of kitchenware in homes, hotels, restaurants, hospitals, etc. It is operated with water from the kitchen pipe line via a hose. It has three systems: Water, Detergent and Power Systems. To integrate these systems together it has a main connecting receiving element (MCRE) which has: valves and ducts for water and detergent, a sleeve plug and a seal to couple the hollow shaft of a drive motor to the MCRE. The MCRE is connected to a detergent reservoir having an integrated injector. The detergent is mixed with water in a T connection formed by the water and detergent ducts. The mixture passes through the hollow shaft. Cleaning is performed by a rotating cleaning head at the end of the hollow shaft. The cleaning head has a brush and an annular fiber scrub pad.

A toothbrush system is provided which includes a handle member (14) which defines an internal handle chamber (22) for containment therein of a cleansing liquid container (28) for containment therein of a cleansing liquid container (28). The handle member (14) is coupled to a head housing (24) which has bristles (20) extending from it. The bristles (20) are displaceably oscillated about a central axis (16) and simultaneously are rotated about an axis which extends in a perpendicular direction to the longitudinal direction (18) and is responsive to the oscillating displacement of the bristles (20). A mechanism is provided for delivering a liquid from the handle (14) through the head member (12) and external the toothbrush system adjacent the bristles (20). In this manner, there is provided pulsating liquid flow from the toothbrush system with a combined rotation and oscillation of the toothbrush bristles (20) in a plurality of planes.

While these devices may be suitable for the purposes for which they were designed, they would not be as suitable for the purposes of the present invention, as hereinafter described.

SUMMARY OF THE PRESENT INVENTION

A primary object of the present invention is to overcome the shortcomings of the prior art.

Another object of the present invention is to provide a multipurpose-bathing accessory with a sponge for the application of various types of appropriate liquids for cleansing the body.

Another object of the present invention is to provide a multipurpose bathing accessory with an alternate interchangeable hollow flexible rubber applicator head for massaging the body and through which various types of appropriate liquids can be introduced and applied while bathing.

Another object of the present invention is to provide a multipurpose bathing accessory with an alternate interchangeable soft bristle brush applicator head for scrubbing different areas of the body and through which various types of appropriate liquids can be introduced and applied while bathing.

Still another object of the present invention is to provide a multipurpose applicator with an extended handle as a means to cleaning areas such as the back which are generally hard to reach by any other means.

Yet another object of the present invention is to provide a multipurpose bathing accessory with a means to allow for the introduction, storage and continuous application of all types of appropriate liquids to aide during the bathing process.

Yet still another object of the present invention is to provide a multipurpose-bathing accessory with interchangeable heads made of a suitable pliable material to allow the applicator to conform to the contours of the body for a more comfortable and effective cleansing action.

Yet even another object of the present invention is to provide a multipurpose bathing accessory with interchangeable heads set at an angle to the handle so that the user may gain easier access to areas of the body which are generally considered more difficult to reach and effectively clean with cleansing devices that use a straight angled applicator head/handle configuration.

Additional objects of the present invention will appear as the description proceeds.

The present invention overcomes the shortcomings of the prior art by providing a multipurpose liquid applicator that combines all the bathing functions addressed singularly by other devices in the field into one comprehensive unit, having no powered components.

The applicator has a long handle for cleaning hard to reach areas such as the back. It is of a two-part construction. The upper hollow section acts a reservoir for liquid soap, suntan lotion, moisturizing lotion etc. Liquids may be either poured directly into the reservoir or, using the lower handle which fits within the upper section and acts as a suctioning and pumping device, the liquids may be extracted from their containers into the reservoir for temporary storage and, thereafter, pumped into the applicator head and to the applicator for use in cleansing.

There are also three applicator heads that fit into the three applicator head subassemblies: one, a sponge head for bathing; two, a hollow flexible rubber head for massaging the body and three, a soft bristle brush head for scrubbing, all of which allow for the continual application of lotion, soap or other liquids during bathing or massaging. The applicator head subassembly has a screw type connection that interfaces with a cooperating threaded upper portion of the reservoir component of the handle. It also has a fluid cavity for the containment of liquids therein, and a matrix of outlet apertures that interface with the inner surface of the applicator body for the even distribution of liquids throughout the applicator. The inner surface of the body of the applicator is typically secured to the head housing by conventional means. The interchangeable heads are set at an ergonomically determined angle to the handle to achieve maximum surface contact and thus maximum cleansing action on areas of the body which can be reached only by the use of the extended handle applied at and within a very restricted angular displacement from those surface areas due to normal physiological limitations. The applicator head subassemblies are also made of a pliable material that more easily conforms to body contours for maximum comfort and effective cleansing.

From the foregoing description it can be seen that the present invention, the Multipurpose Applicator, encompasses all the bathing functions previously found in other devices into one simple comprehensive device, with a choice of several stationary heads, which requires no electrical power or circulating water. Thus it can be said that the present invention represents the most comprehensive approach to providing a means for fulfilling all the needs attentant to batheing and showering activity.

The foregoing and other objects and advantages will appear from the description to follow.

In the description, reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
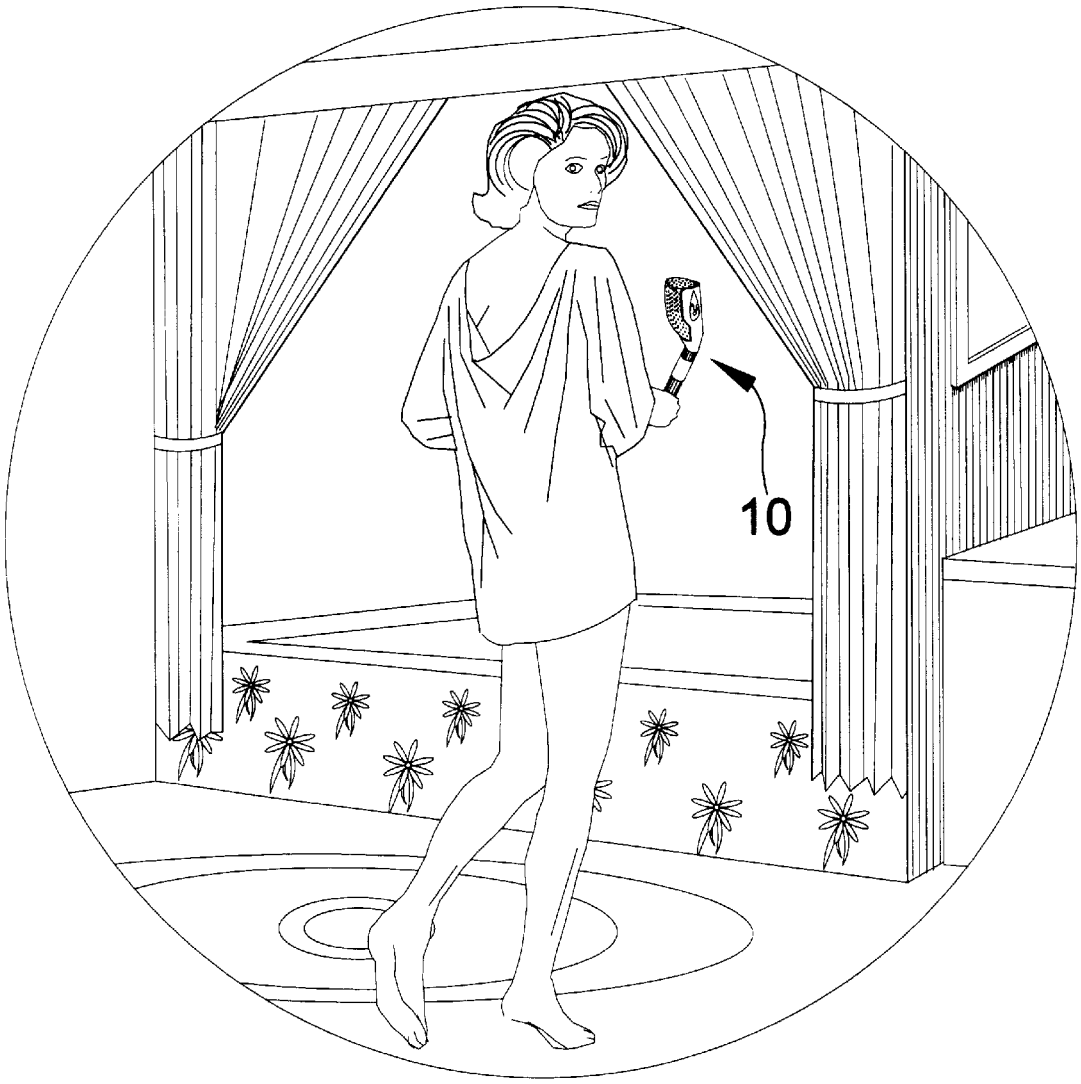
FIG. 1 is a perspective view of a person holding and preparing to use the present invention just prior to bathing.
Figure 2:
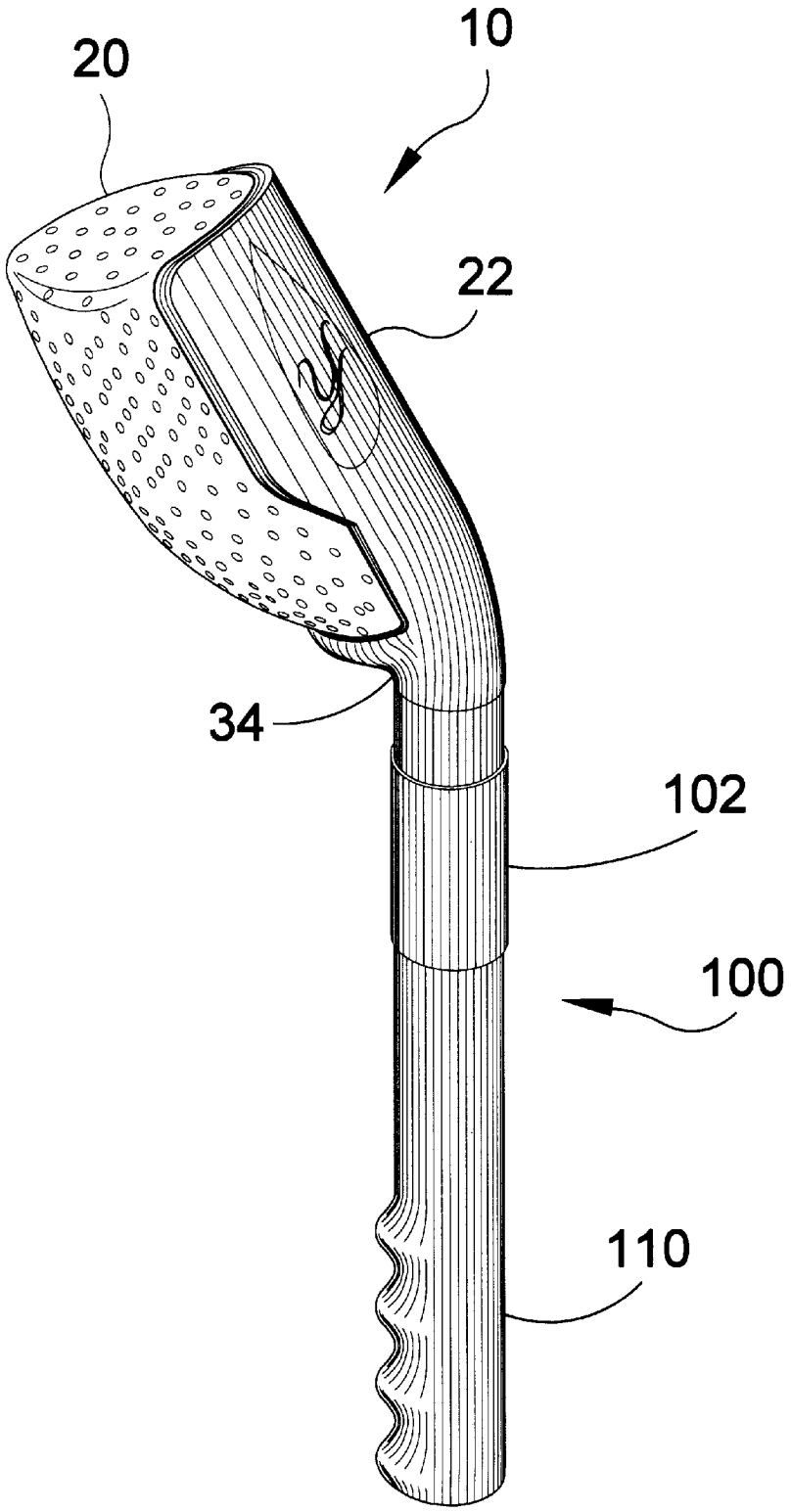
FIG. 2 is a perspective view of the present invention, the multipurpose applicator, with the sponge applicator head installed.
Figure 3:
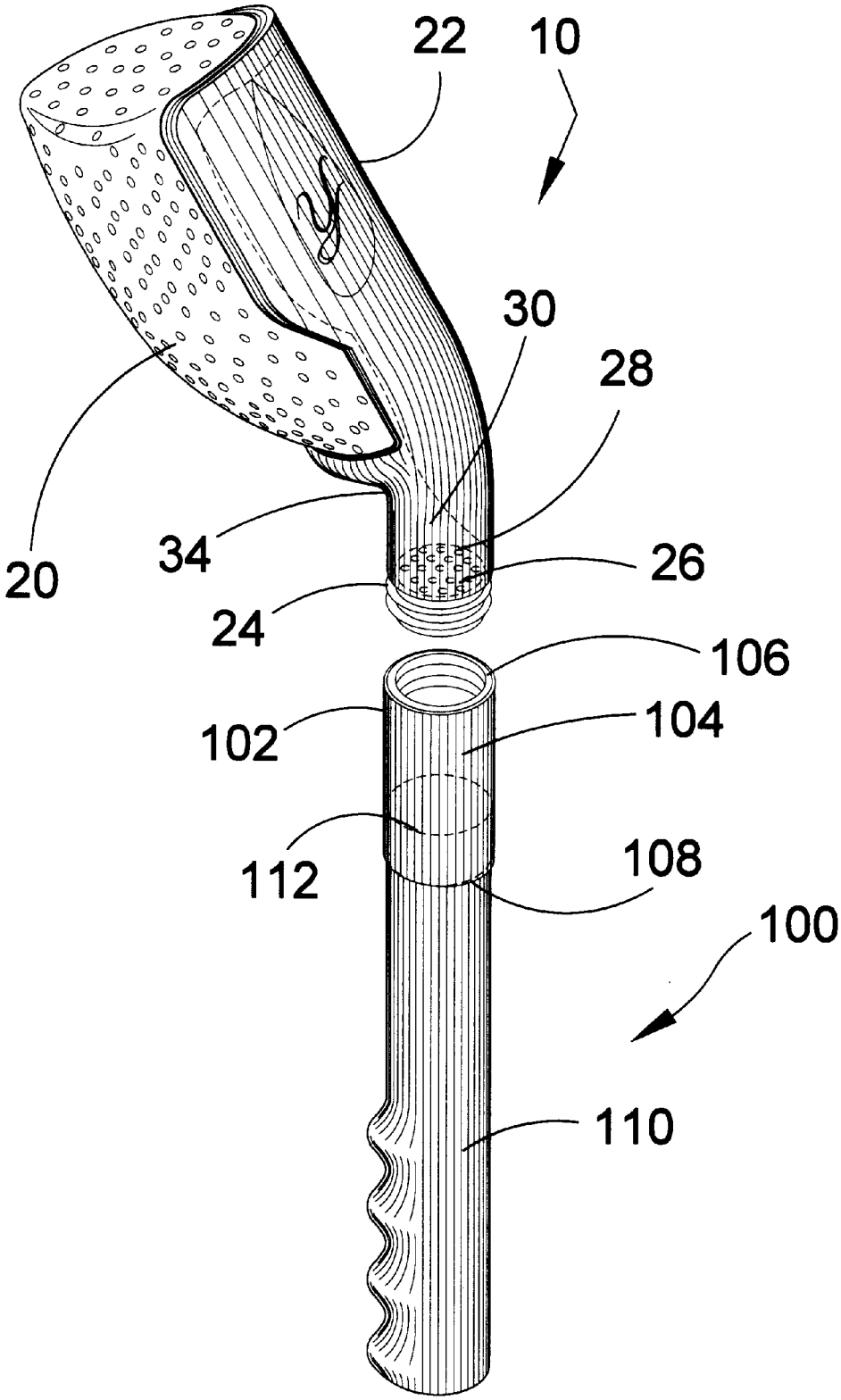
FIG. 3 is a partially exploded perspective of the present invention into two subassemblies: one, the pump subassembly and two, the sponge applicator head subassembly, the view also showing the threaded interface between the assemblies and other internal features in broken lines.
Figure 4:
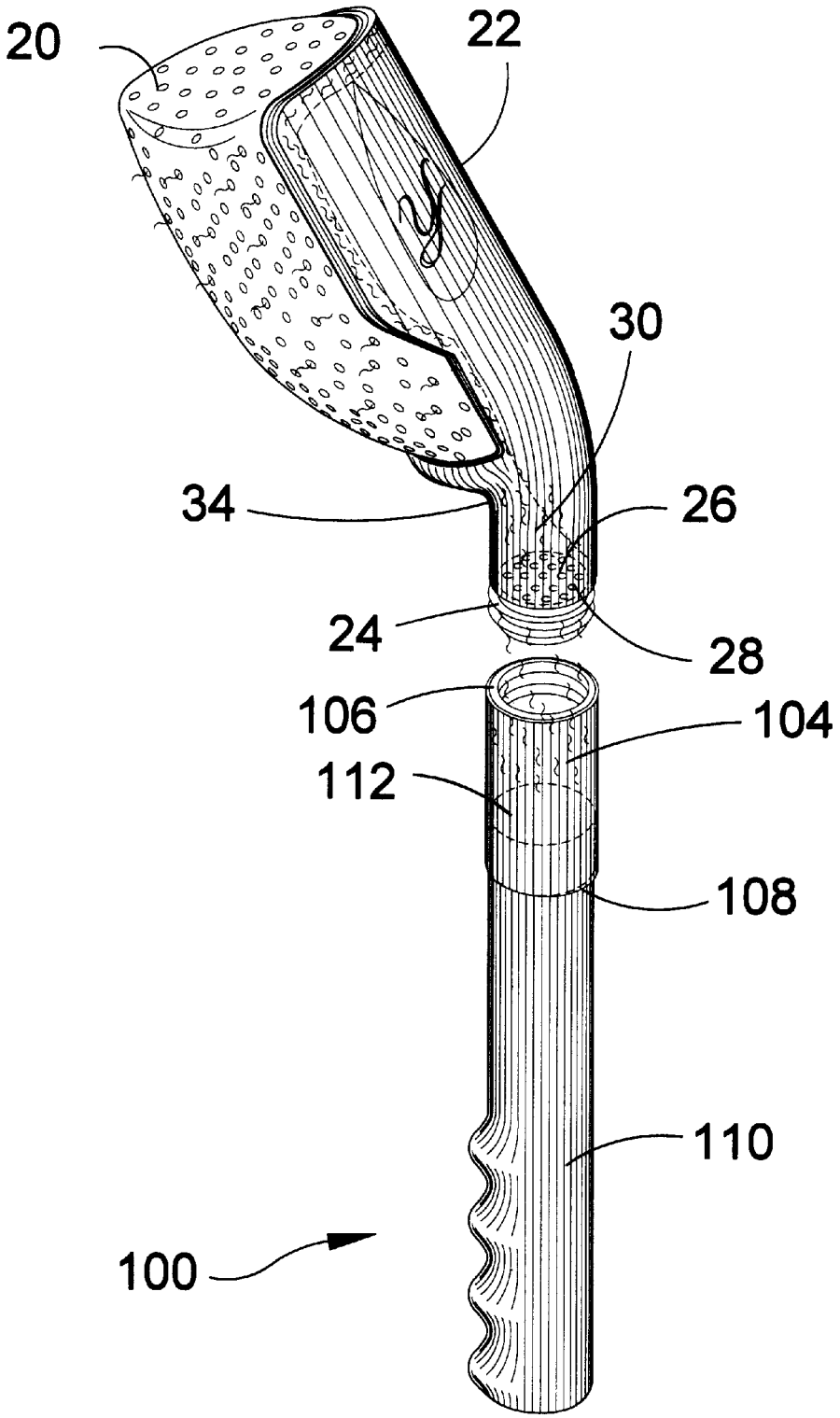
FIG. 4 is similar to FIG. 3 showing the flow of liquid from the pump to the sponge applicator head.

Turning now descriptively to the drawings, in which similar reference characters denote similar elements throughout the several views, the Figures illustrate the multipurpose applicator of the present invention. With regard to the reference numerals used, the following numbering is used throughout the various drawing figures.

10 multipurpose applicator of the present invention
20 sponge head
22 sponge head applicator housing
24 sponge head applicator housing threaded first end
26 sponge head applicator housing baffle
28 sponge head applicator housing baffle apertures
30 sponge head applicator housing cavity
32 sponge head applicator housing apertures
40 hollow flexible rubber head
42 hollow flexible rubber applicator housing
44 hollow flexible rubber applicator housing threaded first end
46 hollow flexible rubber applicator housing baffle
48 hollow flexible rubber applicator housing baffle apertures
50 hollow flexible rubber applicator housing cavity
60 brush head
62 brush head applicator housing
64 brush head applicator housing threaded first end
66 brush head applicator housing baffle
68 brush head applicator housing baffle apertures
70 brush head applicator housing cavity
100 pump subassembly
102 body member
104 body member cylindrical reservoir
106 body member threaded first opening
108 body member second opening
110 handle
112 handle head

DETAILED DESCRIPTION OF THE PREFERRED EMBODIMENT

Turning now descriptively to the drawings, in which similar reference characters denote similar elements throughout the several views, FIGS. 1–12. illustrate the multipurpose applicator of the present invention indicated generally by the numeral 10.

Figure 5:
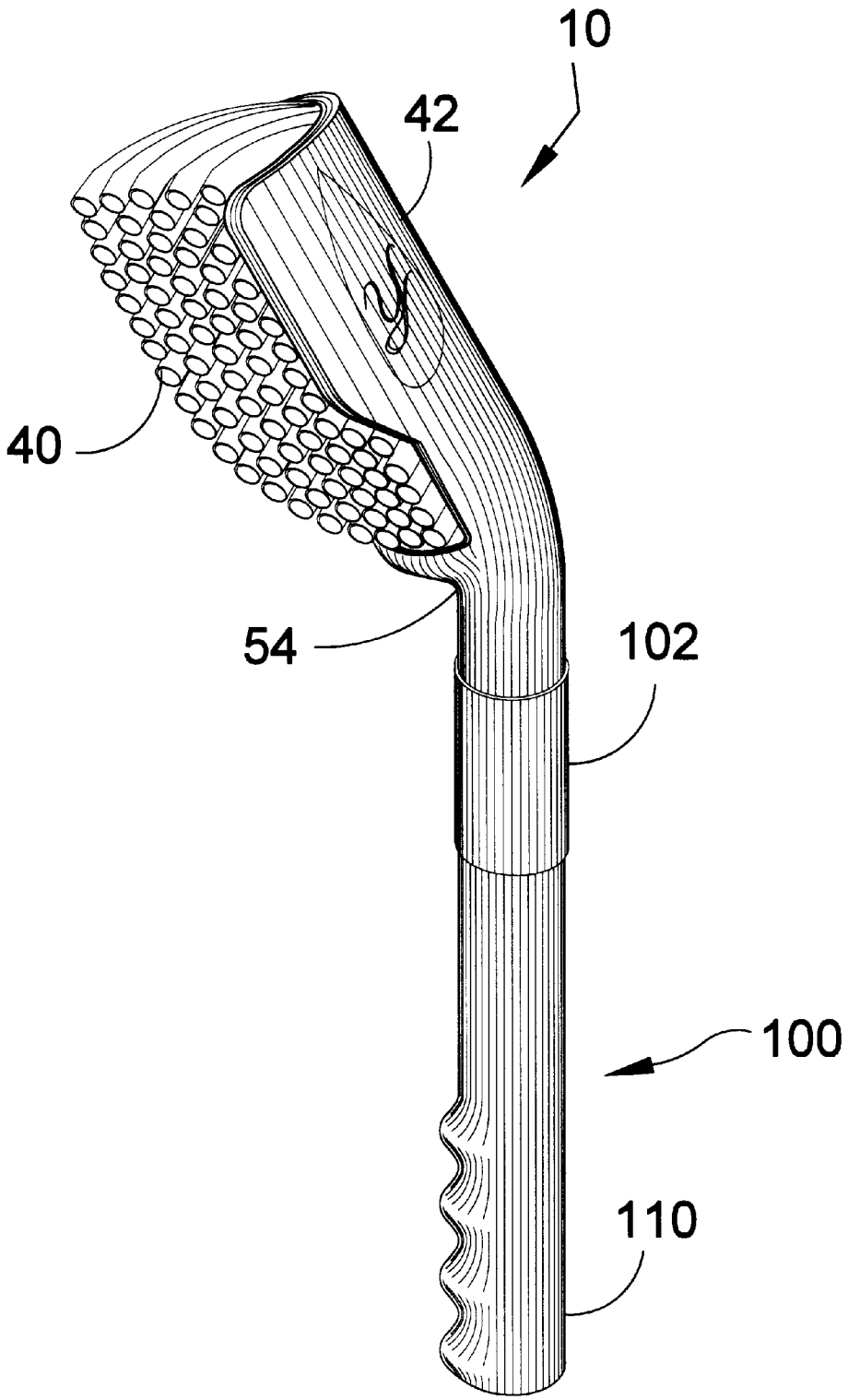
FIG. 5 is a perspective view of the present invention, the multipurpose applicator, with the hollow flexible rubber applicator head installed.
Figure 6:
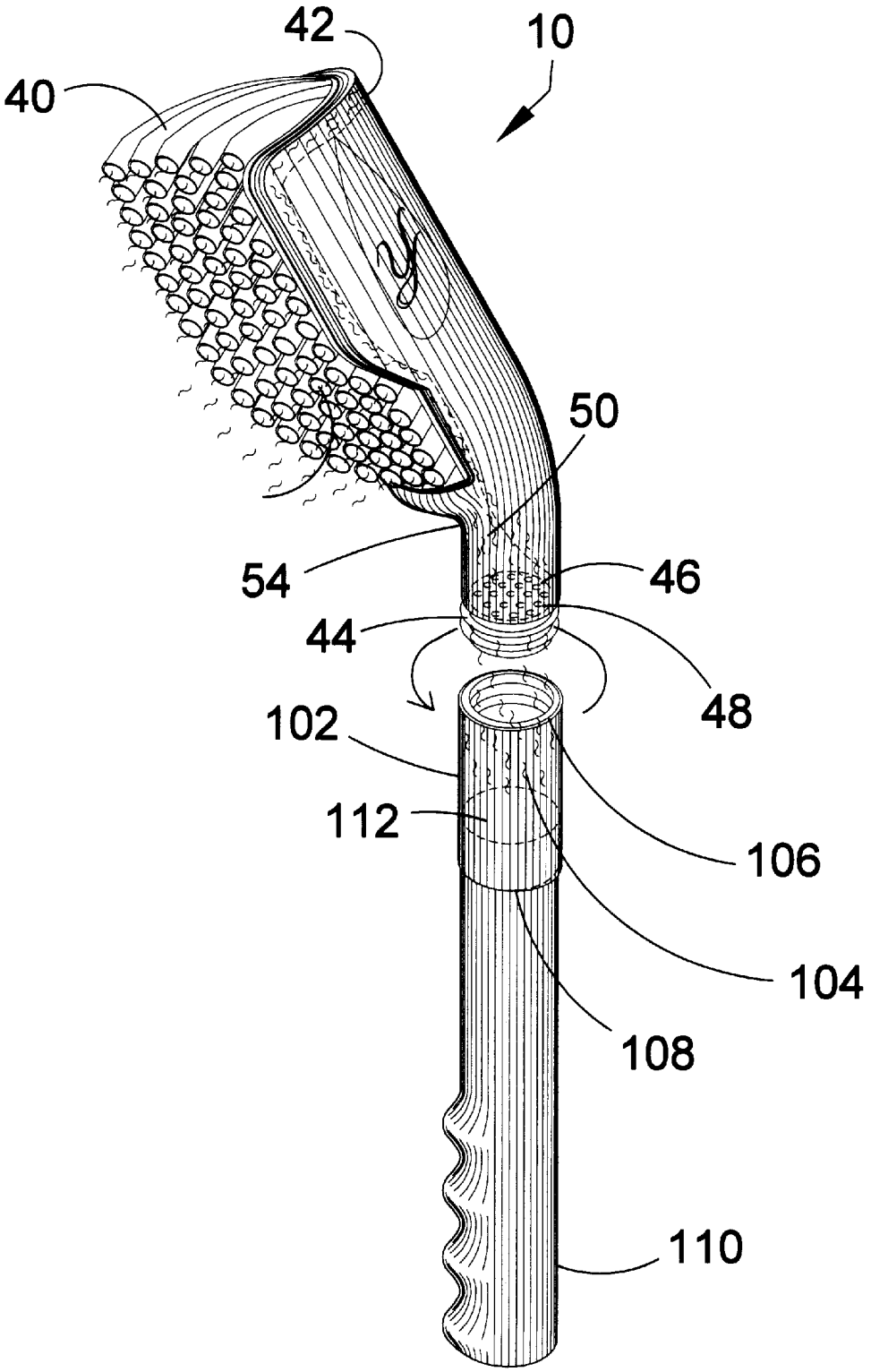
FIG. 6 is similar to FIG. 4 showing the flow of liquid from the pump to the hollow flexible rubber applicator head.
Figure 7:
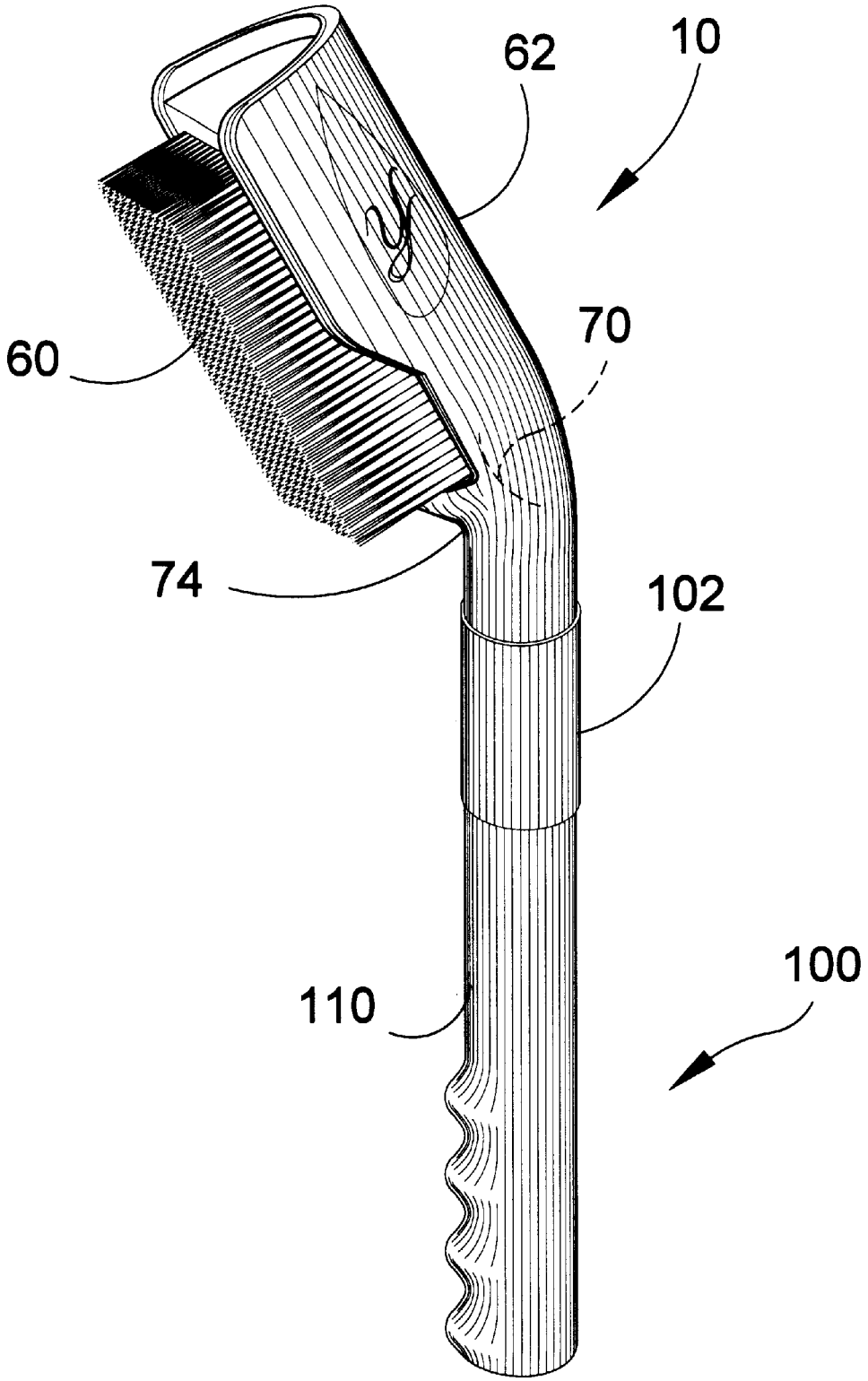
FIG. 7 is a perspective view of the present invention, the multipurpose applicator, with the soft bristle brush applicator head installed.
Figure 8:
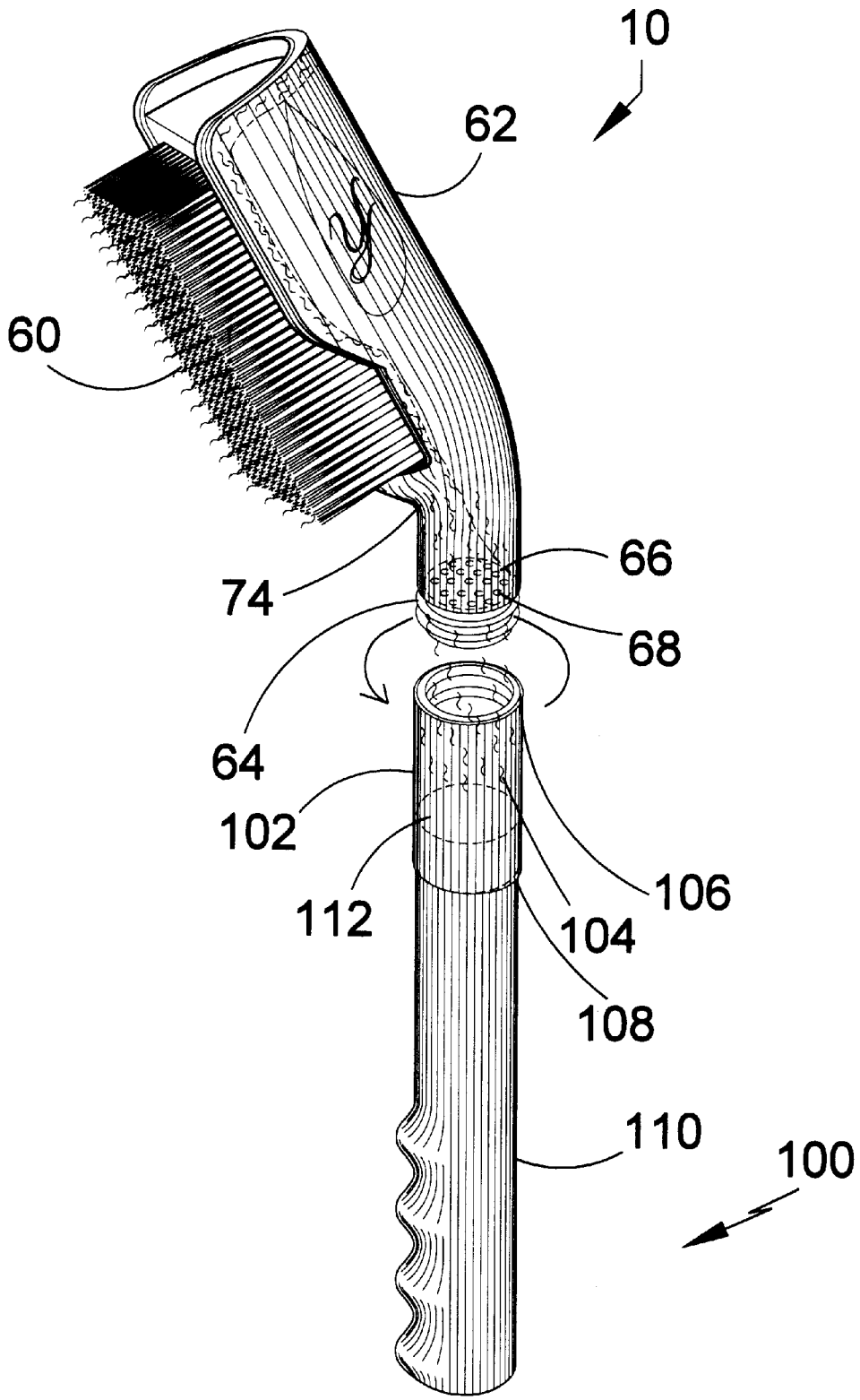
FIG. 8 is similar to FIG. 4 showing the flow of liquid from the pump to the soft bristle brush applicator head.
Figure 9:
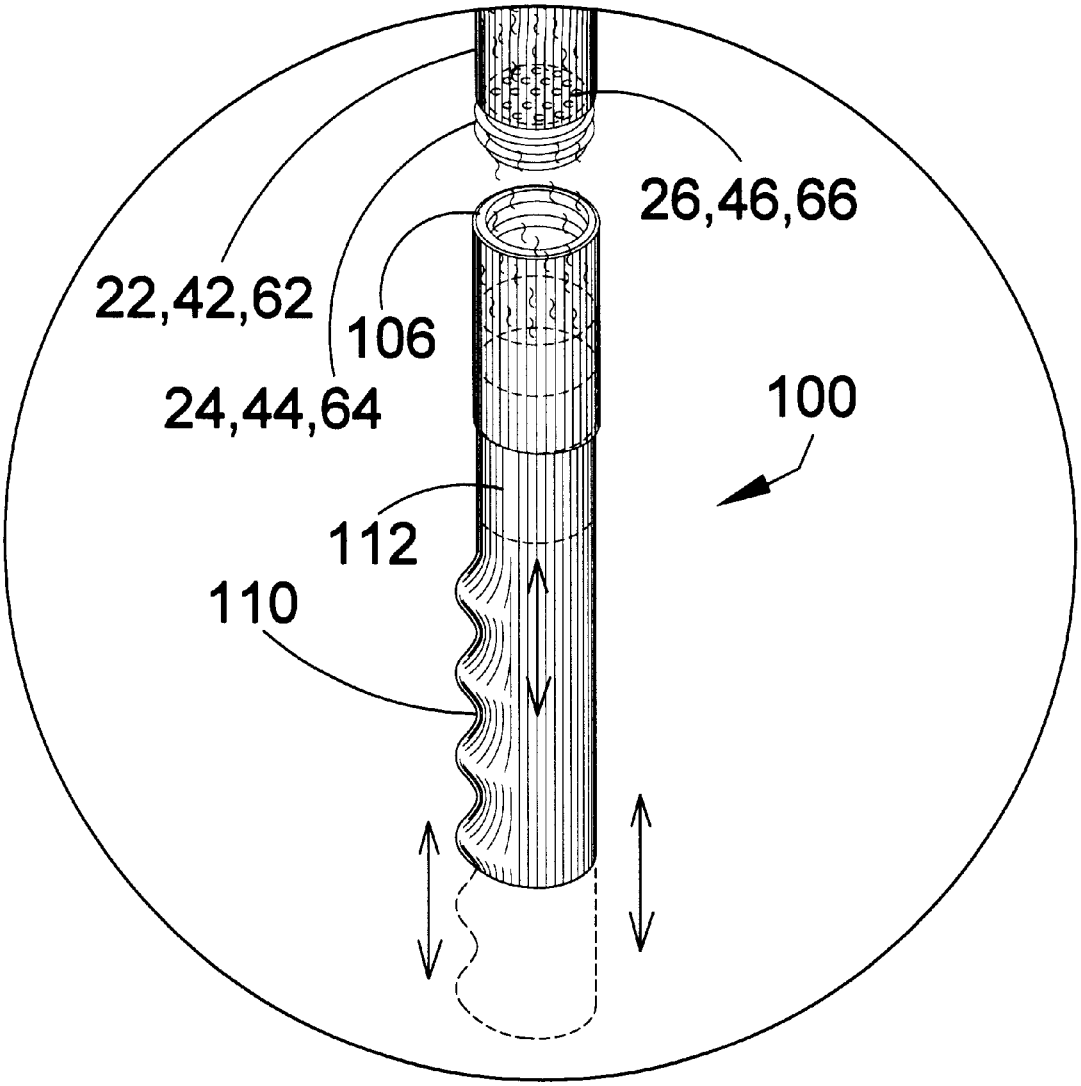
FIG. 9 is a perspective detail view of the exploded handle subassembly and the head subassembly showing the pumping action of the lower handle component into the upper handle component and the resulting flow of fluid into the applicator head.
Figure 10:
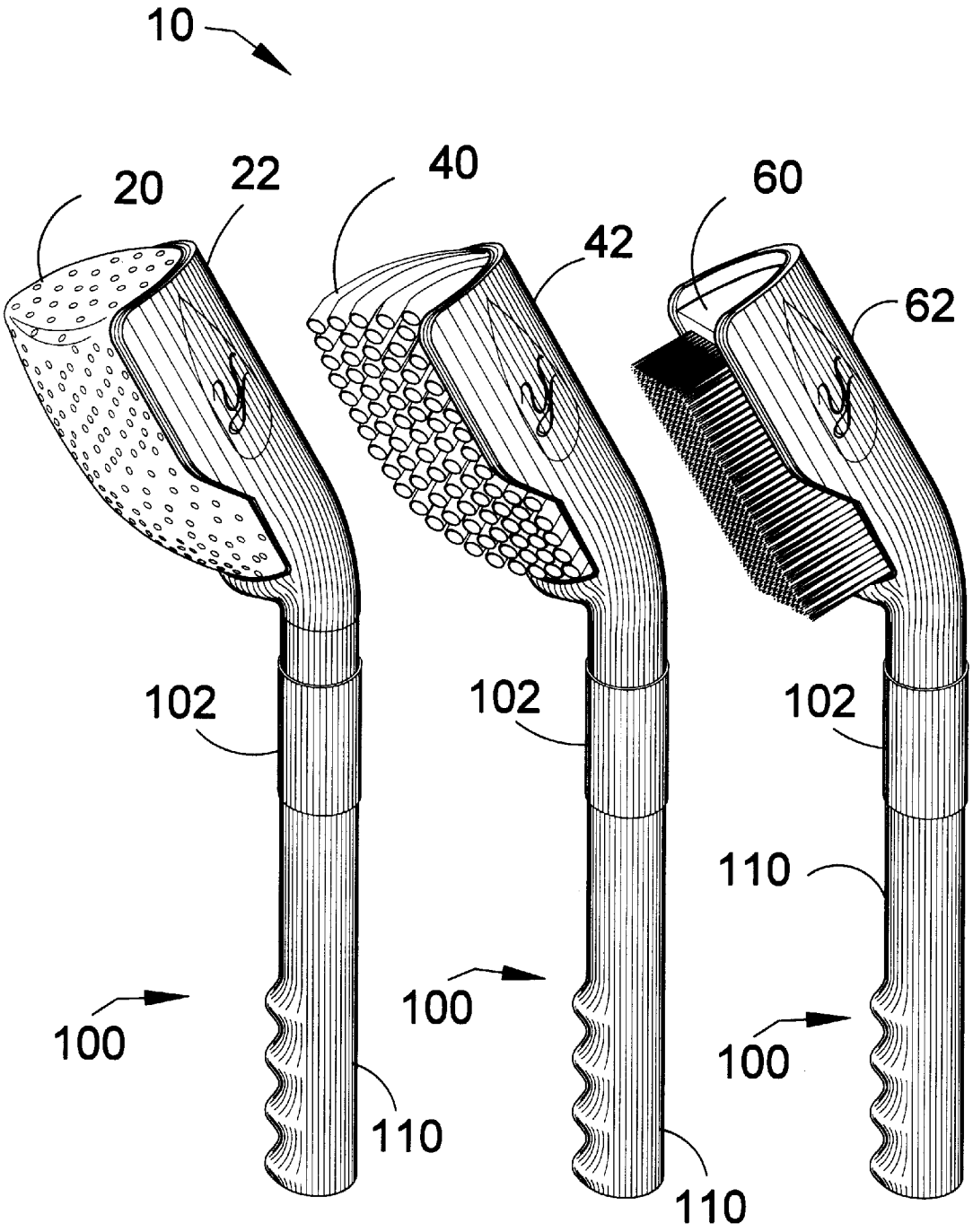
FIG. 10 is a perspective view of all three configurations of the present invention: the sponge applicator head configuration, the hollow flexible rubber applicator head configuration and the soft bristle brush applicator head configuration.

The device 10 is shown in preparation for use in FIG. 1. As shown in FIG. 10, The device 10 has three types of applicator heads available for application of the desired liquid to body surface areas, this embodiment including a sponge head 20, a hollow flexible rubber head 40, and a brush head 60. FIGS. 2–4,10–11 depict the device 10 with the sponge head 20. FIGS. 5–6,10 depict the hollow flexible rubber head 40. FIGS. 7–8,10 depict the brush head 60. Each of heads 20,40,60 has a similarly formed applicator housing 22,42,62, with each such housing having an open, threaded first end 24,44,64, with a baffle 26,46,66 recessed near the opening, the baffle 26,46,66 having apertures 28,48,68 for controlling the flow of the liquid into the applicator housing cavity 30,50,70. The applicator housing 22,42,62 can be made from pliable or rigid materials, such as various plastics and rubber. In this embodiment, the applicator housing 22,42,62 is concave, with the concavity encompassing a substantial portion of the applicator head 20,40,60.

Figure 11:
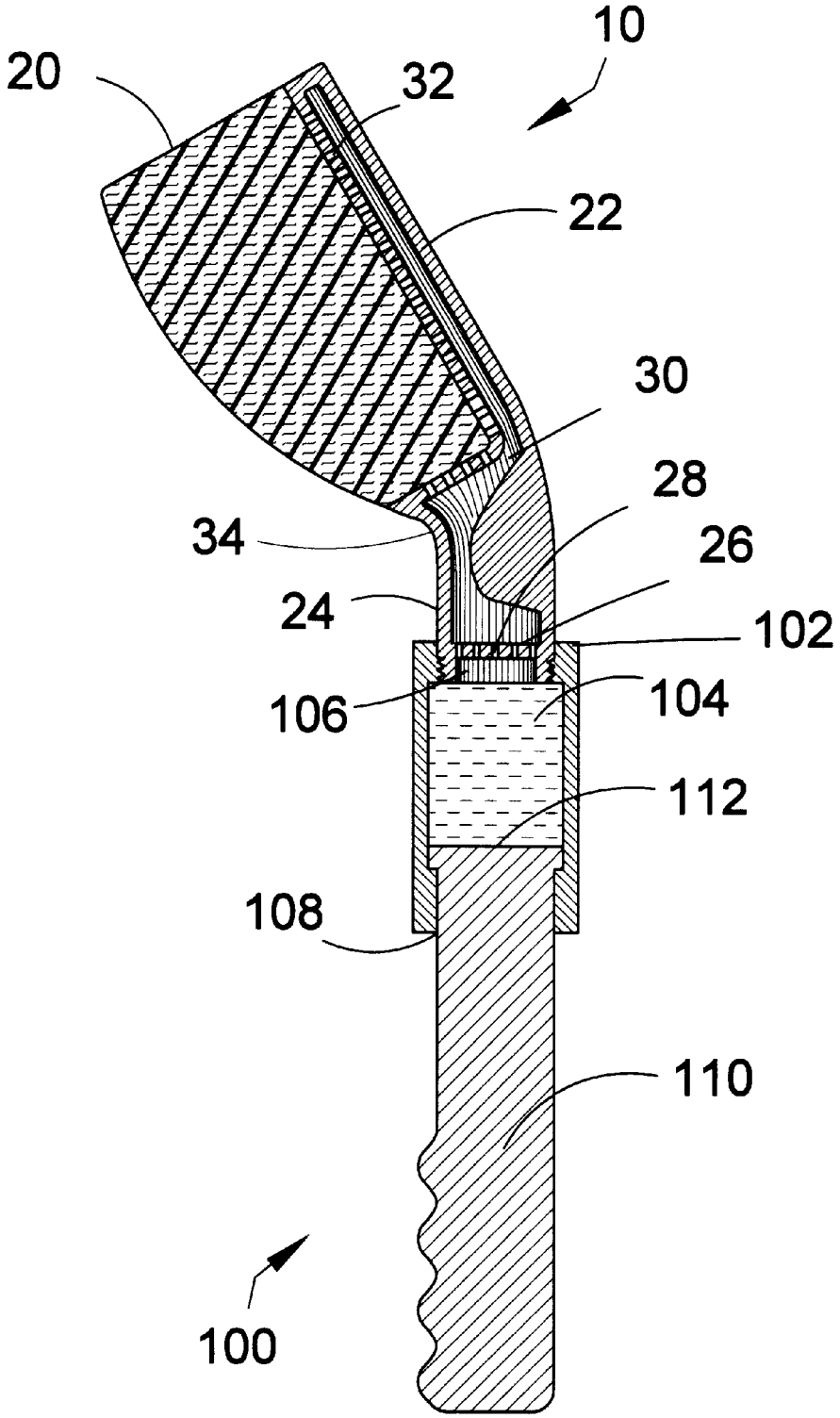
FIG. 11 is a side section view of the present invention.

As shown in FIG. 11, each applicator housing 22,42,62 also has a matrix of apertures 32 through which the liquid exits the housing 22,42,62, for uniform introduction into the applicator head 20,40,60. In this embodiment, each applicator housing 22,42,62 has a bend 34,54,74 that places the applicator head 20,40,60 at an ergonomically determined angle.

A common pump subassembly 100 has a body member 102, the body member having a reservoir 104, as shown in FIG. 11. The body member 102 has an internally threaded first opening 106 that threadably receives the applicator housing threaded first end 24,44,64, forming a fluid passage from the body member 102 to the applicator housing 22,42,62. The body member reservoir 104 may be cylindrical.

The body member 102 has an open second end 108, through which a handle 110 extends in a slidable fashion, the handle 110 having a head 112 acting as a piston for displacing the liquid from the body member reservoir 104 into the applicator housing cavity 30,50,70. The body member reservoir 104 may be cylindrical.

The detachability of the pump subassembly 100 allows the interchangeable use of the three applicator housings 22,42,62, thus allowing multiple types of applicator heads 20,42,60 to be chosen. Such detachability also allows the filling of the body member cylindrical reservoir 104, by submerging the body member first opening 106 into the desired liquid while the handle head 112 is in a position adjacent the body member first opening 106. The handle 110 is then pulled, with the liquid being drawn into the body member cylindrical reservoir 104, through the body member first opening 106.

Once fluid has been placed in the body member cylindrical reservoir 104, the housing applicator first end 24,44,66, is re-attached to the body member first opening 106. The previously pulled handle 110, is ready at this point to be pushed into the body member 102. The handle head 112 displaces liquid into the housing cavity 30,50,70 and ultimately through the housing apertures 32,52,72 and into the applicator heads 20,40,60.

Figure 12:
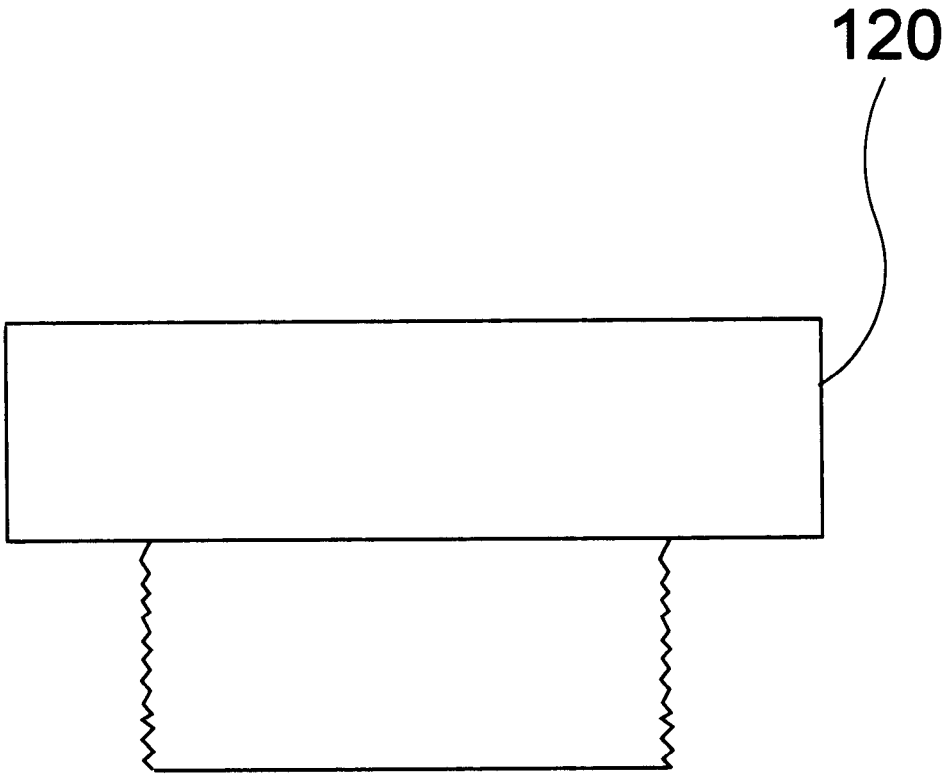
FIG. 12 is a side view of a plug that seals the body member first opening, when the handle assembly is attached.

The plug 120 shown in FIG. 12 is provided to seal the filled body member, if desired, during periods of detachment or non-use.

Although particular materials and features have been discussed, such materials and features could also include applicator heads of other materials such as foam rubber, threaded plugs and caps for the body member opening 106 and the applicator housing opening 24, applicator housings without a bend, and applicator housings without a concave interface with the applicator head, all in accordance with the present invention, and as determined by the intended end use for the overall device, as will occur to those of skill in the art upon review of the present disclosure.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for applying liquids to body surfaces, comprising:

(a) a handle, the handle having a head;

(b) a body member the body member comprising:

(1) a reservoir for holding the liquid to be applied;

(2) a first end, the first end having an opening and internal threads, the first end being in fluid communication with the reservoir;

(3) a second end, the second end having an opening such that the handle shaft extrudes from the body member through the body member second end, when the handle head is within the body member reservoir, the handle head being shaped to be closely received by the body member reservoir, such that movement of the handle toward the body member first end displaces the liquid within the reservoir through the body member first end;

(c) an applicator housing, the applicator housing having a first end, the first end having an opening and exterior threads for threaded joinder with the body member first end, the applicator housing further having a cavity and a baffle, the baffle being apertures such that the housing cavity is in fluid communication with the body member first end opening, the applicator housing further having a plurality of apertures, for discharge of the liquid from the housing cavity;

(d) an applicator head, the applicator head being attached to the applicator housing adjacent the applicator housing apertures, such that the applicator head receives the liquid from the housing cavity, the liquid having first been forced by the handle head from the body member reservoir, then through the applicator housing baffle apertures, and then into the housing cavity; and (e) a. second applicator housing and a second applicator head attached to the second applicator housing.

2. The device of claim 1, wherein the applicator housing has a bend, the bend forming an angle with respect to the handle.

3. The device of claim 1, wherein the applicator head is porous and compressible.

4. The device of claim 1, wherein the applicator head is sponge.

5. The device of claim 1, wherein the applicator head is a brush, the brush having bristles.

6. The device of claim 1, wherein the device further comprises a plug, the plug being sized to be received and retained by the body member first end interior threads, such that the plug seals the liquid within the body member.

7. The device of claim 1, wherein the device further comprises a threaded plug, the threaded plug being sized to be threadably received by the body member first end interior threads, such that the threaded plug seals the liquid within the body member.

8. The device of claim 1, further comprising means for sealing liquid in the body member reservoir when the applicator housing is removed.

9. The device of claim 1, wherein the body member reservoir is cylindrical.

10. A device for applying liquids to body surfaces, comprising:

(a) a handle, the handle having a head;

(b) a body member the body member comprising:

(1) a reservoir for holding the liquid to be applied;

(2) a first end, the first end having an opening and internal threads, the first end being in fluid communication with the reservoir;

(3) a second end, the second end having an opening such that the handle shaft extrudes from the body member through the body member second end, when the handle head is within the body member reservoir, the handle head being shaped to be closely received by the body member reservoir, such that movement of the handle toward the body member first end displaces the liquid within the reservoir through the body member first end;

(c) a plurality of applicator housings, each applicator housing having a first end, the first end having an opening and exterior threads for threaded joinder with the body member first end, each applicator housing further having a cavity and a baffle, the baffle having apertures such that the housing cavity is in fluid communication with the body member first end opening, each applicator housing further having a plurality of apertures, for discharge of the liquid from the housing cavity; and (d) a plurality of applicator heads, each applicator head being attached to one of the applicator housings adjacent the applicator housing apertures, such that each applicator head receives the liquid from the housing cavity, the liquid having first been forced by the handle head from the body member reservoir, then through the applicator housing baffle apertures, and then into the housing cavity.

11. A device for applying liquids to body surfaces, comprising:

(a) a handle, the handle having a head;

(b) a body member the body member comprising:

(1) a reservoir for holding the liquid to be applied;

(2) a first end, the first end having an opening and internal threads, the first end being in fluid communication with the reservoir;

(3) a second end, the second end having an opening such that the handle shaft extrudes from the body member through the body member second end, when the handle head is within the body member reservoir, the handle head being shaped to be closely received by the body member reservoir, such that movement of the handle toward the body member first end displaces the liquid within the reservoir through the body member first end;

(c) an applicator housing, the applicator housing having a first end, the first end having an opening and exterior threads for threaded joinder with the body member first end, the applicator housing further having a cavity and a baffle, the baffle being apertures such that the housing cavity is in fluid communication with the body member first end opening, the applicator housing further having a plurality of apertures, for discharge of the liquid front the housing cavity;

(d) an applicator head, the applicator head being attached to the applicator housing adjacent the applicator housing apertures, such that the applicator head receives the liquid from the housing cavity, the liquid having first been forced by the handle head from the body member reservoir, then through the applicator housing baffle apertures, and then into the housing cavity; and (e) means for interchangeably altering the type of applicator head.

* * * * *